US005405013A

United States Patent [19]

Gee

[11] Patent Number: 5,405,013

[45] Date of Patent: Apr. 11, 1995

[54] SHIPPING CONTAINER FOR PAIRS OF WATER SOLUBLE PACKAGING

[75] Inventor: John F. Gee, Durham, N.C.

[73] Assignee: Rhone-Poulenc Inc., Research Triangle Park, N.C.

[21] Appl. No.: 138,782

[22] Filed: Oct. 19, 1993

[51] Int. Cl.[6] ..... B65B 11/58; B65B 22/B65D; B65B 22/85; B65B 22/82

[52] U.S. Cl. ..... 206/593; 206/594; 206/524.5; 206/524.7

[58] Field of Search ..... 206/524.7, 524.5, 524.4, 206/525, 593, 594

[56] References Cited

U.S. PATENT DOCUMENTS

| | | | |
|---|---|---|---|
| 1,522,902 | 1/1925 | Oppenheim | 206/594 |
| 2,828,902 | 4/1958 | Ringler | 206/594 X |
| 4,223,827 | 9/1980 | Gilbert | 206/524.5 X |
| 4,343,398 | 8/1982 | Snyder et al. | 206/525 X |
| 4,681,228 | 7/1987 | Kerry et al. | 206/524.7 X |

*Primary Examiner*—Jacob K. Ackun
*Attorney, Agent, or Firm*—James G. Passé

[57] ABSTRACT

The invention comprises a containerization system for packaging water soluble bags containing a hazardous chemical such as an agrochemical. The bags are placed in pairs wrapped in an overwrap in a vertical position inside an inner triangular shipping cell of an outer container.

6 Claims, 4 Drawing Sheets

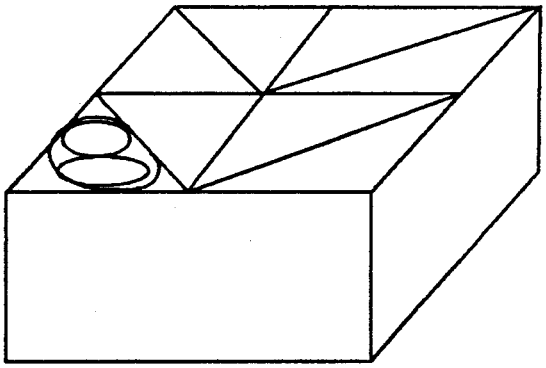
FIG. 1
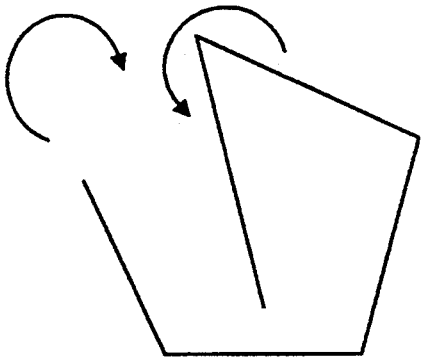
STEP 1
OPTIONAL TAPED JOINT
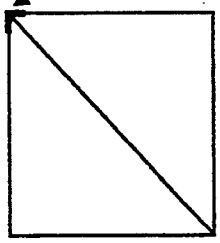
STEP 2
SHIPPED KD
FIG. 4
FOLDING STEPS
STEP 3
OPTIONAL TAPED JOINT
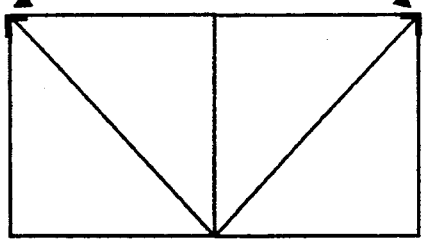
OPENED FOR USE

FILLED BOX ARRANGEMENT

SHIPPING CONTAINER FOR PAIRS OF WATER SOLUBLE PACKAGING

FIELD OF THE INVENTION

The invention relates to a containerization system suitable for containing pairs of packages of hazardous material comprising a rigid container having one or more triangular cells, each cell capable of containing two water soluble packages of hazardous material.

BACKGROUND OF THE PRIOR ART

At the present, hazardous materials such as agrochemicals are packaged in water soluble packages for ease and safety of use, see e.g. GB Patent to Phillips 922,317 and U.S. Pat. No. to Hodakowski 5,080,226, for solid, liquid and gelled contents in a water soluble bag. These bags are tremendous improvements over other packaging such as jugs, drums or the like because of the improvements in prevention of leakage and spillage during transportation, handling, and storage. While these bags represents a major step forward in the distribution and use of hazardous chemicals, flexible containers are difficult to ship and must be placed in some form of shipping containers. Normally, the containers used for shipping hazardous material must meet certain additional strength requirements, for example, strength upon dropping the container. U.S. government regulations require, for example, that the drop and damage resistance of the contents in a shipping container must stop the product from leaving the container. See e.g. Gov. Reg. 49 C.F.R. 178.516, 49 C.F.R. 178.603 and the transfer of dangerous goods 9.7.3.

Normally, rigid containers are used in shipping and handling of hazardous materials to allow shipments of multiple units and to further give protection of the contents. For example, corrugated boxes are normally divided on the inside into additional rectangular or square cells for reception of the desired product. The cell being roughly just large enough to contain the product. Where two products are to be placed in the cell, an appropriately larger cell is used. With water soluble packaging, it has been found that when two water soluble units are placed in the same cell, the units will not pass of the desired drop test. The product breaking out of the water soluble packaging and maybe even the sealed overwrap as well. Current box design then encourages more rather than less breakage when multiple units are placed in a cell. It would be useful to have a design in which two water soluble bags could be placed in a single cell within a rigid container. This would facilitate withdrawals of multiple bags and make construction of the shipping container cheaper and lighter. Normally, however, the design of the cell is just to fit the object and as such the rectangular design is preferred.

SUMMARY OF THE INVENTION

It is a main object of this invention to provide a containerization system for storage and transportation of hazardous chemical products in water soluble bags such as agrochemicals wherein two bags will be placed in each cell which improves the storage and shipping resistance to breaks and leaks, especially leaks from the shipping container. The present invention is directed to a containerization system comprising:

a) one or more pairs of a water soluble or dispersible bag which completely encloses a hazardous chemical or agricultural chemical;

b) one or more protective non water soluble polymeric overwraps enclosing each pair of bags either singlely or together; and c) a rigid outer container for containing the pair or pairs of bags wherein the container has one cell for containing each pair of bags; the cell having a triangular perimeter shape;

wherein each pair of bags is placed vertically in each cell and as a pair is in contact with the surface of the three inner walls of the cell.

In a preferred embodiment of the invention, the container comprises a plurality of cells preferably 4 or 8.

It is a further object of this invention to provide a new containerization system for hazardous chemicals, especially agrochemicals.

Another object is to provide a new system of containing water soluble packages which is easier to use by the end users and minimizes or diminishes risks of container leakage, pollution and contamination. Another object of the invention is to protect the product inside a water soluble bag from escaping to the environment.

Yet another object of the invention is to provide a means to dissipate the force of a shock away from a water soluble bags when transporting said bags in pairs. A further object is to provide a container which is a cost savings advantage in both shipping and manufacturing. These and other objects will be clear to those skilled in the art from the description figures, and example herein.

DESCRIPTION OF THE FIGURES

FIG. 1 is a view of a rigid corrugated container having eight cells, each cell containing two water soluble pouches surrounded by a single overwrap.

FIG. 4 is the method of folding the divider of FIG. 3 to obtain four triangular cells (top down view).

DESCRIPTION OF THE PREFERRED EMBODIMENTS

The containerization system of the present invention comprises one or more pairs of water soluble or dispersible bags enclosing a hazardous chemical such as a agrochemical. The pair either singlely or as a pair enclosed within a non-water soluble polymeric outer overwrap bag. Each pair of bags is contained within one cell of a rigid outer container, the cell having a triangular perimeter.

By "water soluble or water dispersible bag enclosing a hazardous chemical" is meant the distribution and containerization system, for example, in U.S. Pat. No. 5,080,226. This type of system comprises a water soluble or dispensable enveloping film preferably soluble in cold water and a hazardous chemical or agricultural chemical or in other embodiments in solid or liquid form.

The chemical nature of the enveloping film constituting the bag can vary quite widely. Suitable materials are water soluble (or possibly water dispersible) materials which are insoluble or compatible with the active ingredients and other contents.

A preferred enveloping film comprises or is made from polyvinylalcohol (PVA). When PVA is used, it is preferably partially or fully alcoholized or hydrolyzed, e.g., 40–100%, preferably 80–99% alcoholized or hydrolyzed, as a polyvinyl acetate (or other ester) film. Copolymers or other derivatives of such polymers can also be used.

Additional preferred materials for constituting the bags in the invention are polyethylene oxide, methylcellulose, and polyvinylalcohol.

A hazardous chemical can be any compound which can easily cause extreme injury to persons exposed to the chemical or which can easily damage the environment. Examples are acids, bases, caustics, poisons, and agrochemicals. An agricultural chemical or agrochemicals are compounds such as pesticides (e.g., herbicides, fungicides, nematocides, insecticides, etc.) and plant protection agents (e.g., plant growth regulators, nutrients, etc.). Agrochemicals also include plant adjuvants such as penetrating agents and the like.

Hack's Chemical Dictionary, 5th Edition, says that Hazardous chemicals are chemicals that may cause loss of life or property by improper handling, shipping, or storing.

Those Hazardous chemicals or agricultural chemicals may be in any convenient form, for example, solid, liquid, or gel and are preferably water soluble or dispersible. Solids are preferred chemicals of the invention.

In practice, the Hazardous chemical used in the invention and is contained in the water soluble bag comprises the active ingredient, which is the hazardous chemical in association with ingredients that participate in or assist in the formation of the product, for example, surfactants, dispersants, thickeners, solvents and gelled or gelling agents.

Figure 5:
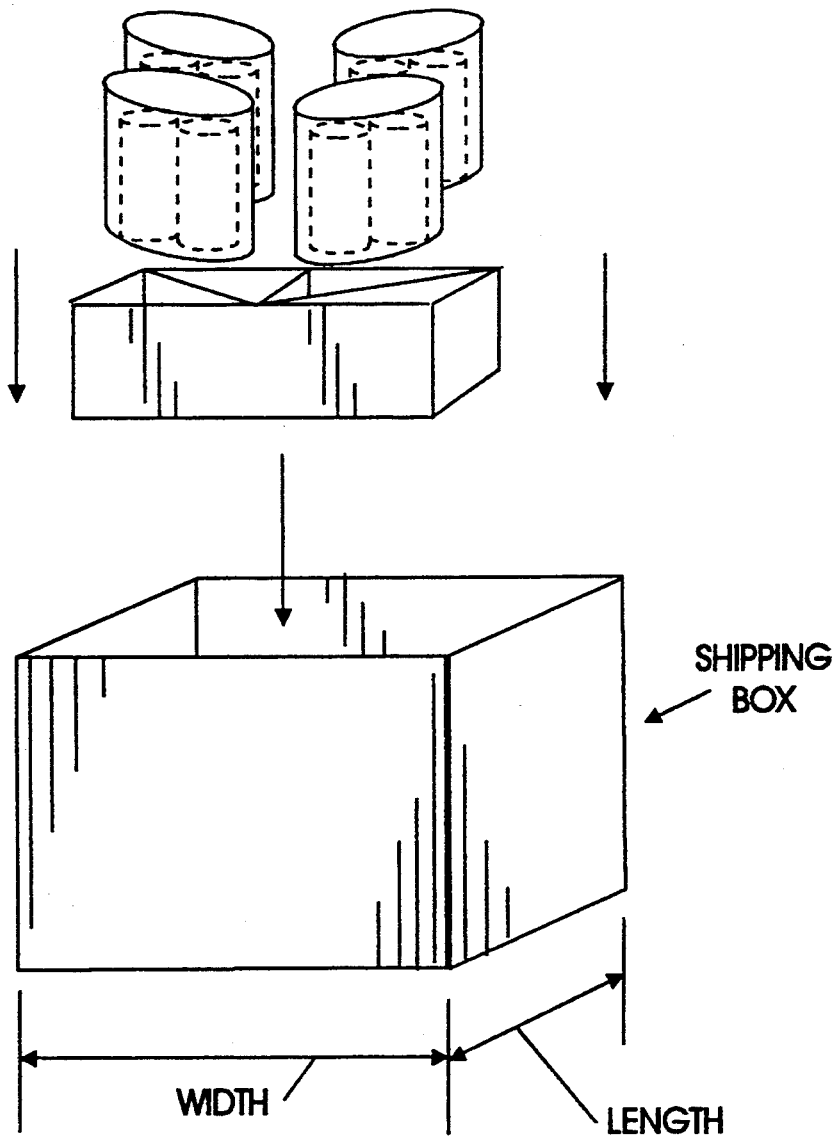
FIG. 5 is an exploded view of four pairs of bags being inserted into ½ of a container of Example with space for another four pairs.

It is required that the bag also be enclosed in an additional non-water soluble flexible bag. In the event of severe trauma which does break the bag the outer bag will help contain any leak. The bag may contain each bag separately or contain them both as in the example and FIG. 5. Such overwrap bags are normally polymeric such as polyethylene, but one skilled in the art could easily choose others.

By rigid containers, herein is meant those rigid containers normally used to ship product such as water soluble bags. These are normally made of corrugated board but can be made of plastic, metal, wood, or any other similar rigid material approved for use in the shipping trade.

By triangular perimeter shape is meant that the cell has three sides forming a triangle preferably a right triangle. Since the bag is placed vertically in the cell, the perimeter and dimension should be such that the bag pair is in contact with the cell walls. Thus for a very snug fit, a small of perimeter is used for a loose fit, a larger perimeter is used. The perimeter should not be so large that one or more cell walls is not in contact with some part of the pair. Likewise a preferred embodiment is that the bag pair fits snugly in the cell making some light pressure required to overcome the friction of insertion.

The following examples are representative of the invention and are not intended to be limiting. Other choices of materials, methods, sizes, and the like will be readily apparent to those skilled in the art on viewing the disclosure and examples.

EXAMPLE

Figure 2:
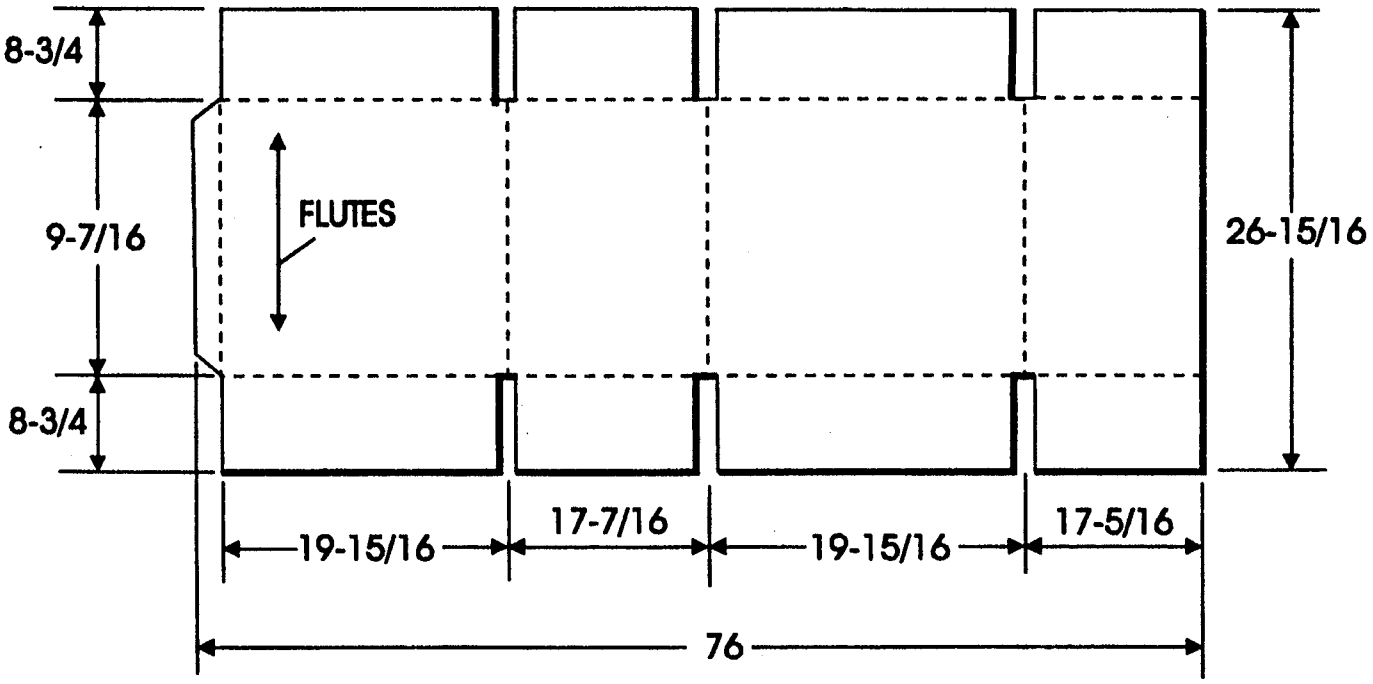
FIG. 2 is a corrugated container of Example 1 unfolded to show dimensions.
Figure 3:
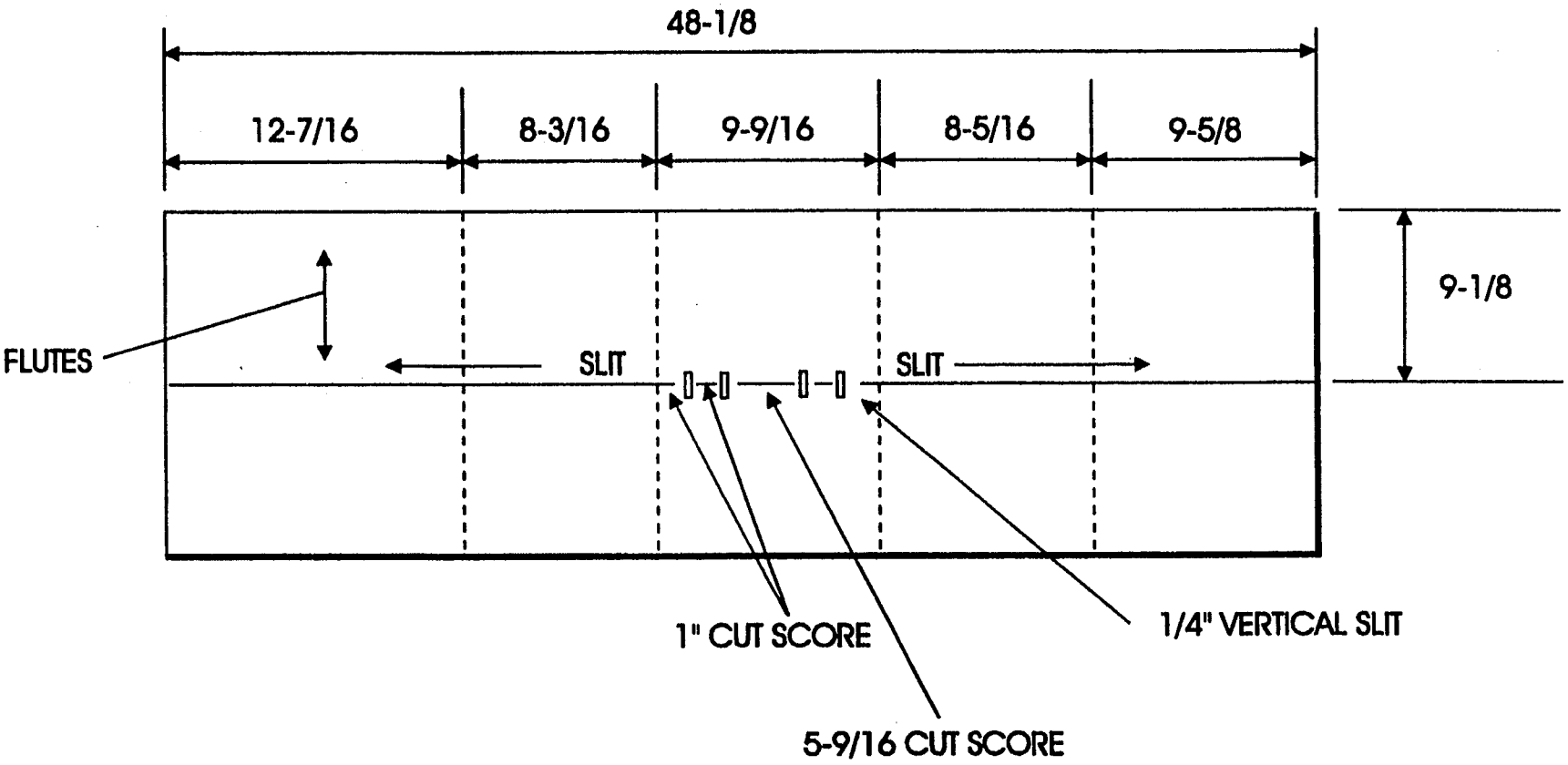
FIG. 3 is a corrugated divider which is folded to make four cells, two of which are used in the container of Example 1.

A corrugated paper box is constructed having the dimensions corresponding to FIG. 2. After inserting two folded dividers of FIG. 3, a box according to FIG. 1 is made having a total of eight cells, each cell having 2 bags contained vertically within a single sealed polyethylene bag. Each bag contained 2½ lbs. of LARVIN® brand insecticide/ovicide in a PVOH water soluble bag. This container was subjected to the U.N. packaging group 3, drop tested (31 inches) and compared with pairs of bags in rectangular cells. In the instant invention no damage to the inner bag occurred while several of the pairs in the rectangular cells opened, spilling their contents.

What is claimed is:

1. A containerization system for shipping hazardous chemicals comprising:
   a) one or more pairs of water soluble or dispersible bags which completely encloses the hazardous chemical;
   b) a protective non-water soluble polymeric over wrapping enclosing each bag individually or enclosing the bags in pairs such that the bags are free to move in all directions independent of the overwrap;
   c) a rigid outer container having a separate cell for containing each pair of bags, each cell having three walls forming a closed triangular shape; wherein each pair of bags is placed vertically into each cell and wherein the cell is of sufficient size that one or the other of the bags is in contact with each of the three walls of the cell.

2. A containerization system according to claim 1 wherein the hazardous chemical is an agrochemical.

3. A containerization system according to claim 2 wherein the agrochemical is in solid form.

4. A containerization system according to claim 1 wherein the rigid container is of corrugated board.

5. A containerization system according to claim 1 wherein one overwrap contains two bags.

6. A containerization system according to claim 1 wherein the container comprises a plurality of pairs of bags.

* * * * *